United States Patent [19]

Tozzi

[11] Patent Number: 4,760,820

[45] Date of Patent: Aug. 2, 1988

[54] PLASMA JET IGNITION APPARATUS

[76] Inventor: Luigi Tozzi, 4566 Springbrook Dr., Columbus, Ind. 47203

[21] Appl. No.: 946,145

[22] Filed: Dec. 23, 1986

Related U.S. Application Data

[63] Continuation of Ser. No. 636,169, Jul. 31, 1984, abandoned, which is a continuation of Ser. No. 515,557, Jul. 20, 1983, Pat. No. 4,471,732.

[51] Int. Cl.[4] ..... F02P 3/08; F02P 33/00; F02B 19/10; F02B 17/00

[52] U.S. Cl. ..... 123/143 B; 315/344; 315/343; 315/111.41

[58] Field of Search ..... 123/143 B, 143 R, 144, 123/274, 253, 536, 537, 620, 538; 315/111.41, 343, 344; 313/118; 261/1, 72

[56] References Cited

U.S. PATENT DOCUMENTS

| | | | |
|---|---|---|---|
| 1,054,886 | 3/1913 | Wielgolaski | 315/343 |
| 3,059,910 | 10/1962 | Moriya | 261/72 |
| 3,219,866 | 11/1965 | Dingman | 313/118 |
| 3,266,733 | 8/1966 | Knight | 261/1 |
| 3,266,783 | 8/1966 | Knight | 123/537 |
| 3,445,722 | 5/1969 | Scott et al. | 315/111.41 |
| 3,939,816 | 2/1976 | Espy | 315/111.41 |
| 4,130,781 | 12/1978 | Dethlefsen | 315/344 |
| 4,130,782 | 12/1978 | Dethlefsen | 315/344 |
| 4,219,001 | 8/1980 | Kumagai et al. | 123/143 B |
| 4,230,448 | 10/1980 | Ward et al. | 123/536 |
| 4,293,794 | 10/1981 | Kapctanakos | 315/344 |
| 4,393,333 | 7/1983 | Sakudo et al. | 315/111.41 |
| 4,493,297 | 1/1985 | McIlwain et al. | 123/143 B |
| 4,494,043 | 1/1985 | Stallings et al. | 315/111.41 |
| 4,512,867 | 4/1985 | Andreev et al. | 315/344 |

*Primary Examiner*—Raymond A. Nelli

*Attorney, Agent, or Firm*—Woodard, Emhardt, Naughton Moriarty & McNett

[57] ABSTRACT

A plasma jet ignitor apparatus for generating plasma from a plasma medium such as hydrogen and for discharging the plasma as a jet into the combustion chamber of an internal combustion engine. The apparatus has a plug which has an electrode from which a high energy spark is generated. The spark causes hydrogen which is introduced into the plasma generation cavity by a fuel line to become plasma. The plasma generation cavity is defined by magnetic field generation means. The cavity has an inlet opening adjacent the plasma generation location and an outlet orifice. The plasma is ejected as a plasma jet from the cavity from the orifice. The magnetic field generation means is disposed as a magnetic field coil wound about the cavity. The magnetic field is charged by the discharge of a capacitor at the time of the formation of the plasma in the cavity. The magnetic field accelerates the plasma out of the cavity through the orifice so that the plasma exits as a high velocity jet and achieves effective penetration. Timing means are also included for timing the introduction of hydrogen into the cavity, the discharge of the plasma generating spark and the triggering of the magnetic field.

9 Claims, 1 Drawing Sheet

PLASMA JET IGNITION APPARATUS

This application is a continuation of application Ser. No. 636,169, filed July 31, 1984, now abandoned, which is a continuation of Ser. No. 515,557, filed July 20, 1983, now U.S. Pat. No. 4,471,732.

BACKGROUND OF THE INVENTION

The present invention relates to an ignition apparatus and, more particularly, to a plasma jet ignition apparatus for generating and discharging a jet of plasma for igniting fuel in combustion chambers of power sources such as internal combustion engines and the like.

Power sources such as internal combustion engines and the like rely on the combustion of fuel as their primary source of energy. This combustion usually occurs in one or more combustion chambers where the fuel is ignited by various ignition means. The fuel that is most often used for these power sources are hydrocarbon based fuels such as gasoline and diesel fuel. In the past, the efficiency of the power sources which used these fuels was not as important as it is today. World events have made the crude oil from which many of those fuels are derived both expensive and in scarce supply. The need for refinement of that crude oil into various octane and cetane levels required for conventional ignition systems also adds to this expense. Additionally, environmental concerns have also required that such power sources provide for improved efficiency and reduced emission of environmentally harmful exhaust by-products. This present situation calls for higher efficiency engines and less costly fuels.

Efficiency can be improved and emissions reduced by the use of special materials and structural changes to recuperate kinetic and thermal energies from the exhaust gases. Many attempts and designs have been directed to this aspect of the problem. The other means for improving efficiency and reducing emissions is by the improvement of the combustion process which can be accomplished through the use of sufficient ignition apparatus for the combustion of lean air/fuel mixtures. Present ignition systems use conventional spark plugs which discharge a high voltage-low energy spark of approximately 0.01 Joules into the combustible mixture. This spark ignites a small volume of the mixture which in turn spreads through the volume of the mixture at the speed of the flame front to ignite the rest of the mixture. This mixture usually contains a high-octane gasoline fuel in a rich air/fuel mixture. Lean air/fuel mixtures do not burn as well because the flame speed of the front is reduced. Because the actual burning rate and ignition delay of this system depends upon the physical chemistry of the fuel extremely sophisticated combustion chambers have been necessary to produce slight improvements in ignition delay and burning rate. Additionally, high octane or high cetane fuels are needed which are more expensive and scarce. Moreover, because conventional spark plug ignition systems require relatively rich air/fuel mixtures for proper combustion it is important to precisely maintain this air/fuel mixture for efficient operation. Thus the conventional ignition systems limit the useful operating range of both low and high compression ratio internal combustion engines and the like.

An ignition system that could reduce the fuel ignition delay and promote faster burning rates would immprove fuel economy, reduce emissions, and extend the useful operating range of the engine in terms of the air/fuel mixture and also in terms of the types of fuels that could be used. Running an engine with lean air/fuel mixtures presents numerous of the above advantages. The excess air provides for nearly complete combustion of hydrocarbons and carbon monoxide which are usually released as exhaust gases. The greater dilution of the charge with a lean mixture results in a lower peak temperature attained within the combustion chamber. This reduces the formation of nitric oxide pollutants. The ratio of specific heats of fuel-air mixtures increases as leaner mixtures are employed. This means higher thermal efficiency at a given compression ratio. Output power may be controlled by just the variation of the air/fuel ratio in a lean mixture. This avoids the use of a throttle valve, which generally introduces pressure drops and a resulting decrease efficiency. Thus the use of lean mixtures results in a decrease in pollutant production and increases in efficiency.

As pointed out, conventional spark plugs do not efficiently cause combustion of lean mixtures and either misfiring occurs or there is no combustion. The typical spark of a conventional spark plug is highly localized and ignites a very small volume of fuel in the general vicinity of the surface of the spark. The small initial flame front produced from the spark is slowed in lean mixtures resulting in long ignition delay and poor combustion because of insufficient penetration of the flame front into the volume of the lean mixture within the combustion chamber. For efficient burning of such mixtures the flame speed must be increased.

The stratified charge engine is one structure which has been employed to attempt to gain the benefits of burning leaner air/fuel mixtures. The basis of this design is to provide for an initial combustion chamber in which a very rich air/fuel mixture is first ignited into a flame. Because of the pressure resulting from the chemical combustion this flame then enters the main combustion chamber to ignite a leaner mixture contained within the main chamber. The process requires chemical combustion in the initial chamber and the restructuring of the basic design of various internal combustion engines so that this initial chamber is provided for. These engines also require additional components, valves, and other design changes to present engines to allow for the use of the initial combustion of a rich mixture.

Another system for burning lean mixtures is based on the use of plasma jets. Basically these various systems create a jet of plasma which is introduced into the main combustion chamber. This jet causes the combustion of the fuel in the combustion chamber. The basic structure provides for an initial cavity in which a small amount of gas or the like is introduced. This gas is subjected to an electric discharge of high energy. This causes the gas to become a hot ionized gas otherwise known as plasma. Because of a great and quick buildup in pressure this plasma rushes out of an orifice in the cavity into the main combustion chamber as a jet or plume of plasma. Unlike the stratified engine flame this jet enters the combustion chamber at supersonic speeds. The physical chemistry of this jet improves the ignition of lean mixtures because of the velocity and penetration into the chamber of the jet. Further the jet cause turbulence within the combustion chamber and this further enhances the combustion of the lean mixtures. These fluid mechanical effects of the plasma jet on ignition have an appreciable effect over an appreciable amount of time and thereby enhance the complete ignition and combustion of the lean mixture within the combustion chamber. The chemical effects on the ignition occur because of the presence of free radicals in the plasma which react with the lean fuel mixture to increase the combustion rate. Plasma jet ignition is also much less sensitive to timing so that this is a further improvement over conventional spark plugs where efficiency is reduced if the timing is awry.

It has been recognized in the art that a plasma jet ignition system would have many advantages for use in internal combustion engines. Plasma jet ignitors can be adapted to be placed into internal combustion engines with relative ease. They provide for controllable ignition factors, improve fluid mechanical aspects of ignition, and offer an excellent means by which lean mixtures may be burned to extend the operating ranges of conventional engines. This of course provides all of the advantages of burning of lean mixtures in terms of fuel savings and pollutant reduction. Plasma jet igniters are also less timing sensitive.

As has been pointed out the plasma medium, the magnitude and duration of the energy that generates the plasma, the size of the plasma cavity and the size of the orifice all affect plasma jet ignition effectiveness. The initial velocity of the plasma jet as it enters the main combustion chamber governs the penetration of the jet and its ability to cause turbulence and enhance combustion. This velocity has been controlled by the dimensions of the plasma forming cavity and the ejection orifice. The duration and the amount of energy imparted to the plasma also governs the initial velocity. Higher energies must be discharged through the spark plug electrodes than for conventional spark plugs to generate plasma jets of sufficient pressure to be able to achieve the advantages of penetration and turbulence mentioned for enhanced combustion. These high energies tend to erode electrodes at a faster rate and to erode the orifice and cavity shape of the plugs. The need to be able to place plasma jet plugs within conventional engines provides constraints on the cavity and orifice size. Additionally the use of too high an energy level to create the plasma increases the temperature and in some instances this increase in temperature leads to the production of nitrous oxides.

The present invention provides for a plasma jet ignitor that can be easily adapted for use with internal combustion engines. It improves combustion and reduces pollutants by providing a jet of plasma that will ignite lean levels of fuel/air mixtures. The invention also provides for an external magnetic field means to accelerate the plasma jet so that the jet achieves good initial velocity so that it achieves the appropriate penetration into the combustion chamber to provide for the most efficient combustion of the fuel mixture. Because of the use of external means to accelerate the jet, the cavity size and the orifice size are not as constrained. Further the initial energy needed for the electrode discharge does not need to be as great. This means that the electrode life will be increased and that the temperature will not be as high thus reducing the creation of pollutants. Further advantages and features of present invention are discernable from the disclosure that follows.

SUMMARY OF THE INVENTION

A plasma jet ignitor apparatus for generating plasma from a plasma medium and for discharging the plasma as a jet. The apparatus comprises electrode discharge means for discharging energy to generate plasma from the plasma medium at a plasma generation location, magnetic field generation means defining a plasma cavity. The cavity has an inlet opening adjacent the plasma generation location and an outlet orifice. The inlet opening provides flow communication between the plasma generation location and the cavity. The magnetic field generation means being for generating a magnetic field to accelerate plasma in the cavity out the outlet orifice so that a jet of plasma exits from the outlet orifice.

Accordingly, an object of the present invention is to provide an improved plasma jet ignition apparatus.

Related objects and advantages of the present invention will become apparent from the following figures and detailed description.

DESCRIPTION OF THE PREFERRED EMBODIMENT

Figure 1:
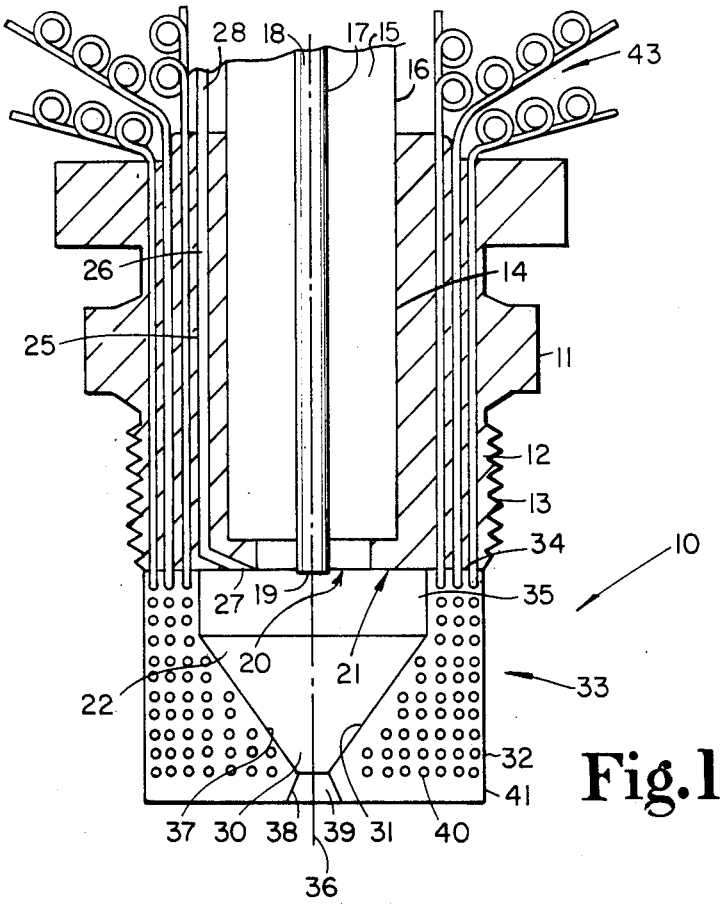
FIG. 1 is a partial side elevational view in cross section of a typical embodiment of a plasma jet igniter according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is shown the preferred embodiment of a plasma jet ignitor apparatus 10 for generating plasma from a plasma medium and for discharging the plasma as a jet. The apparatus 10 is useable with an internal combustion engine for generating a jet of plasma into a combustion chamber of the internal combustion engine to ignite a fuel in the combustion chamber. The present structure as hereinafter described can be used to replace conventional spark plugs with the plasma jet ignition plug 11 shown in FIG. 1. Only the bottom portion of the plug 11 need be shown for an understanding of the invention because the upper portion has the structure of any conventional spark plug. Because the general external geometry of the plug 11 is like a conventional spark plug it can be placed in the conventional spark plug receptacle of a conventional internal combustion engine.

The plug 11 has a housing 12 which is made of metal and has means for attaching the plug 11 at a location adjacent the combustion chamber of an internal combustion engine. These means are the external screw threads 13 which mate with the threads of a conventional spark plug receptacle. Of course any other desired size of threads may be used. The housing has a central bore 14 in which electrode discharge means 15 are disposed within the housing 12 for discharging energy. The electrode discharge means 15 have a ceramic body 16 which is a cylinder of ceramic material which is received in the bore 14 of the housing 12. This ceramic body 16 has a central bore 17 in which an electrode 18 is disposed.

Figure 2:
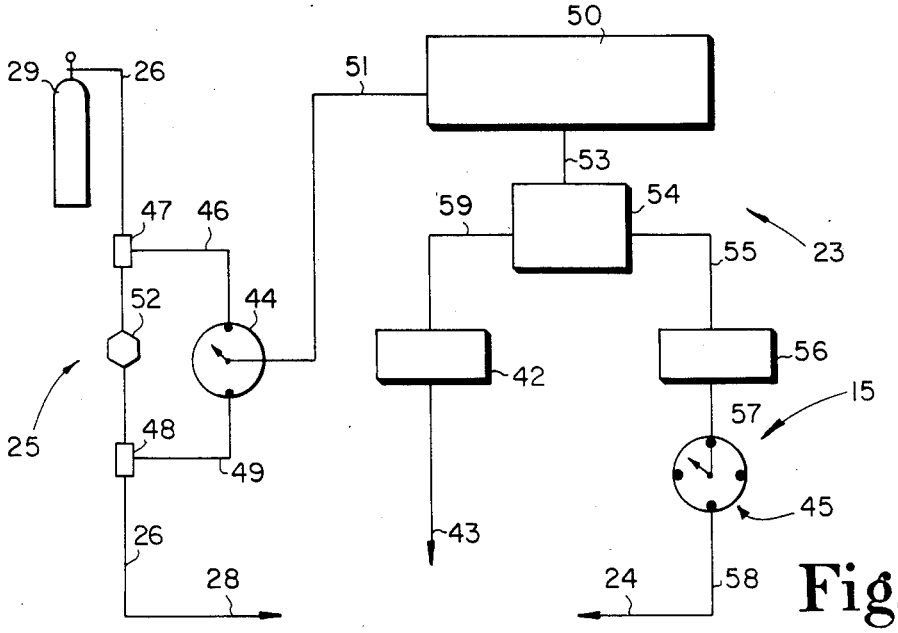
FIG. 2 is a block diagram of a plasma jet ignition system according to a typical embodiment of the present invention.

The electrode 18 has a discharge end 19 from which electrical energy is discharged and a spark occurs in the spark gap 20 between the electrode end 19 and the ground electrode 21. This spark gap 20 is also adjacent the plasma generation location 22 at which the energy from the discharge of the electrode generates plasma from a plasma medium. The electrode discharge means further includes electrical means 23, as shown in FIG. 2 which is electrically engaged as shown diagrammatically at 24 with the electrode 18 for providing electrical energy to the electrode to cause a discharge of energy at the plasma generation location. As shown in FIG. 2 the source of the electrical energy is a conventional 12 volt power source 50. This source 50 is in electrical engagement by line 53 with a trigger voltage source 54. Line 55 electrically connects the trigger 54 with a high energy ignition coil 56 which is connected to distributor 45 and then to the electrode. The functioning of this electrical means in the preferred embodiment shall be more fully explained hereinafter.

The electrode discharge-means includes plasma medium introduction means 25 as shown in FIGS. 1 and 2. The plasma medium means 25 have a plasma medium passageway 26 disposed in the housing 12. This passageway 26 has a plasma medium outlet opening 27 disposed adjacent the plasma generation location 22. The opposite second end 28 of the passageway 26 is disposed in flow communication with a plasma medium source 29 which contains a supply of plasma medium. Thereby a flow communication is established between the plasma medium source 29 and the plasma generation location 22 for introducing plasma medium to the plasma generation location. As shown in FIG. 2 the plasma medium passageway 26 has a first solenoid valve 47, then an injection calibrated cavity 52 which holds a, in the preferred embodiment a calibrated amount of plasma medium for calibrated injection into the cavity 30. There is also a second solenoid valve 48 down the line before the passageway 26 enters the plug 12. The functioning of this plasma medium introducing means in the preferred embodiment shall be more fully explained hereinafter.

In the preferred embodiment the plasma medium that is used is Hydrogen gas. Other types of plasma mediums are of course possible. Hydrogen gas has been found to reduce fuel ignition delay and to enhance the combustion caused by the plasma generated from the hydrogen. Nitrogen may be used as the plasma medium if it is desired to reduce nitrous oxide emissions. Fuel and water mixtures reduce hydrocarbon particulate emissions.

As shown in FIG. 1 the plug 12 has a plasma generation cavity 30 at its lower end. The cavity inner wall 31 is defined by a magnetic field generation means 33. The actual inner wall that is included as part of the magnetic field generation means, in the preferred embodiment, is an integral inner wall of the housing 12. An alternative design is to provide the inner wall as part of a shroud 32 that is securely attached to the housing 12 at its lower portion 34. The plasma cavity shroud 32 has an open portion 35 adjacent the plasma generation location 22. The open portion 35 is adapted to be secured to the electrode discharge means housing 12. The integral wall or the shroud provide two approaches by which the present invention can be achieved. One approach is the constructing of the magnetic field generation means integrally with the remainder of the plug 12. The other approach is the use of a shroud 32 which is attached to conventional plasma jet plug design so that the enhancement provided by the present invention's magnetic field generation means, as hereinafter explained, may be realized for those plugs also.

The cavity 30, whether defined by the housing or the shroud wall, has an inlet opening or open portion 35 adjacent the plasma generation location 22. The cavity also has an outlet orifice discharge means as shown by the orifice 36. The inlet opening or open portion 35 provides flow communication between the plasma generation location 22, the cavity 30 and the cavity discharge orifice means 36. The cavity 30 shown in FIG. 1 has a conical shape 37 towards the orifice 36 and the orifice 36 has a conical shape 38 towards the cavity 30. When the plug 12 is in an internal combustion engine the outlet orifice 36 is in flow communication with the combustion chamber so that the plasma jet goes from the cavity and into the combustion chamber to ignite the fuel in the chamber. In the preferred embodiment, the cavity 30 has a volume of approximately 50 cubic millimeters and the orifice 36 has an open diameter 39 of 1 millimeter. Variations in the cavity size and orifice diameter are possible and such variations will affect the velocity and penetration of the plasma jet and such variations are intended to be within the scope of the present invention.

The present invention provides magnetic field generation means 33 for creating a magnetic field to accelerate the jetting of the plasma from the plasma generation location 22 through the cavity 30 and out the orifice 36 as a jet. The magnetic field generation means 33 includes a magnetic field coil 40 disposed about and defining the plasma generation cavity 30. This field coil 40 is embedded in the preferred embodiment in a ceramic cap 41. This cap 41 of course can be integral with the plug housing 12 or it can be part of the shroud 32. The magnetic generation means 33 further includes magnetic field electrical energy means 42 electrically engaged 43 with the magnetic field coil 40 for introducing electrical energy into the field coil 40 to produce the desired magnetic field for the acceleration of the plasma out of the cavity 30 through the orifice 36. The electrical energy means 42 include the electrical engagement of the magnetic field coil 40 with the triggering device 54 by line 59. The functioning of these electrical energy means 42 in the preferred embodiment shall be described below.

The preferred embodiment of the present invention also has timing means 44 and 45 for timing the introduction of plasma medium by the plasma medium introduction means with the discharge of energy by the electrode discharge means with the acceleration of the plasma by the magnetic field generation means. The timing means include distributor 44 and distributor 45. Distributor 44 is engaged with the plasma medium introduction means 25. One engagement is with a first solenoid valve 47 by line 46 and the second engagement is with solenoid valve 48 by line 49. Distributor 44 is powered by a conventional 12 volt power supply 50 through power line 51. Distributor 45 is electrically engaged by line 57 with the high energy ignition coil 56 and electrically engaged with the electrodes 18 by line 58. The timing means functioning for the preferred embodiment shall be more fully explained below.

The operation of the preferred embodiment will now be explained. The present invention provides for an apparatus and system for ejecting a jet of plasma into for example, a combustion chamber. This jet is accelerated by a combined action of a static pressure and an accelerating magnetic field. At the beginning of a cycle or initially the timing distributor 44 triggers solenoid valve 47 and the plasma medium which is hydrogen flows from the plasma medium source 29 to the calibrated injection cavity 52. At this time valve 48 is already shut off. In the preferred embodiment the injection cavity holds approximately 0.05 milligrams of hydrogen. Distributor 45 then shuts off valve 47 and triggers solenoid valve 48 and the calibrated amount of hydrogen flows through passageway 26 and is introduced into the 50 cubic millimeter plasma generation cavity 30 from outlet opening 27. Distributors 45 is timed relative to distributor 44 so that distributor 45 triggers the electrical means 23 for the electrode discharge means. This timing depends on the engine load but is usually only a few moments after the hydrogen enters the plasma generation cavity 30. In the preferred embodiment, this causes a high energy spark of approximately 0.7 joules to be discharged by the electrode 18 at the plasma generation location 22. This high energy spark causes the hydrogen to become a hot ionized gas otherwise known as plasma. In the preferred embodiment, due to the extremely short deposition time of approximately 50 microseconds at which the electrical energy is discharged, an abrupt increase in temperature and pressure is caused within the plasma cavity 30. Since this pressure is much greater than the pressure outside of the cavity, the plasma generated is ejected from the cavity 30 through the orifice 36.

To improve and control the penetration of the jet so that the most effective penetration will occur the magnetic field means 33 is energized during the plasma formation. The magnetic field electrical means 42 are connected to the power supply 50 through the trigger voltage source 54. The magnetic field electrical means 42 at the time of the electrode discharge cause a large amount of energy, of approximately 10 joules, stored in a capacitor to be discharged into the magnetic field coil 40 which is wound around the cavity 30. This creates an appreciable magnetic field which accelerates the plasma jet so that good penetration is achieved. With the dimensions recited herein as the preferred embodiment the plasma jet has been ejected by this invention to an approximate depth of 5 centimeters within a combustion chamber. Thereby good combustion results due to increased flame speed, turbulence, and larger flame front resulting in multi-point ignition.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A plasma ignition apparatus for generating plasma and for propelling said plasma from said ignition apparatus for ignition external to said ignition apparatus, said ignition apparatus comprising:

means defining a cavity;

electrical energy discharge means cooperatively arranged with said cavity and arranged for generating an electrical energy discharge in said cavity, said electrical energy discharge being at a level sufficient to generate plasma within said cavity and below a level at which the generated plasma is propelled from the cavity and capable of ignition external to the cavity; and magnetic field generation means establishing a magnetic field within said cavity, said magnetic field providing a supplemental propelling force on said generated plasma, the strength of said magnetic field being predetermined based upon the energy level of said discharge and the geometry of said cavity so as to propel the generated plasma from the cavity for ignition external to the cavity, whereby electrode erosion is minimized and ignition and flame propagation are enhanced.

2. The plasma ignition apparatus of claim 1 wherein said cavity defines an outlet orifice and said magnetic field propels said generated plasma out of said ignition apparatus through said outlet orifice.

3. The plasma ignition apparatus of claim 2 wherein said magnetic field generation means is disposed external to said cavity.

4. The plasma ignition apparatus of claim 3 wherein said magnetic field generation means includes a first circuit portion controlling the current and voltage level of said magnetic field generation means and wherein said electrical energy discharge means further includes a second circuit portion controlling the current and voltage level of said electrical energy discharge.

5. A plasma ignition apparatus for generating plasma and for propelling said plasma from said ignition apparatus for ignition extenal to said ignition apparatus, said ignition apparatus comprising:

means defining a cavity;

electrode means arranged relative to said cavity for discharging electrical energy in said cavity at a level sufficient to generate plasma within said cavity and below a level at which the generated plasma is propelled from the cavity and capable of ignition external to the cavity;

first circuitry means cooperatively arranged with said electrode means for controlling the level of current and voltage of electrical energy discharged by said electrode means;

magnetic field generation means for establishing a magnetic field within said cavity, said magnetic field providing a supplemental propelling force on said generated plasma, the strength of said magnetic field being predetermined based upon the energy level of said discharge and the geometry of said cavity so as to propel the generated plasma from the cavity for ignition external to the cavity; and second circuitry means cooperatively arranged with said magnetic field generation means for controlling the generation of said magnetic field, whereby electrode erosion is minimized and ignition and flame propagation are enhanced.

6. The plasma ignition apparatus of claim 5 wherein said cavity means features an outlet orifice and said magnetic field propels said generated plasma out of said ignition apparatus through said outlet orifice.

7. The plasma ignition apparatus of claim 5 wherein said magnetic field generation means is disposed external to said cavity.

8. A plasma ignition apparatus for generating plasma and for propelling said plasma from said ignition apparatus, said ignition apparatus comprising:

means defining a cavity;

electrode means arranged relatively to said cavity for discharging electrical energy in said cavity at a level sufficient to generate plasma at a predetermined location within said cavity and below a level at which the generated plasma is propelled from the cavity and capable of ignition external to the cavity;

magnetic field generation means for establishing a magnetic field within said cavity, said magnetic field providing a supplemental propelling force on said generated plasma, the strength of said magnetic field being predetermined based upon the energy level of said discharge and the geometry of said cavity so as to propel the generated plasma from the cavity for ignition external to the cavity; and control means providing energy to said electrode means and said magnetic field generation means to create a current and voltage level for said magnetic field generation means and a current and voltage level for said electrode means, whereby electrode erosion is minimized and ignition and flame propagation enhanced.

9. A plasma ignition apparatus designed for generating plasma and for propelling said plasma from said ignition apparatus, said ignition apparatus comprising:

means defining a cavity;

electrical energy discharge means cooperatively arranged with said cavity and designed and arranged for generating an electrical energy discharge in said cavity, said electrical energy discharge being sufficient to generate plasma within said cavity and of an energy level substantially lower than that of typical prior art plasma ignitors; and magnetic field generation means designed and arranged to establish a magnetic field within said cavity, said magnetic field co-acting with said generated plasma and creating a propelling force on said generated plasma to move said generated plasma out of said cavity, the generation of said magnetic field being accomplished independently of the energy level of said electrical energy discharge, the strength of said magnetic field having a designed relationship to the energy level of said electrical energy discharge, whereby electrode erosion is minimized and ignition and flame propagation are enhanced.

* * * * *

UNITED STATES PATENT AND TRADEMARK OFFICE

CERTIFICATE OF CORRECTION

PATENT NO. : 4,760,820

DATED : August 2, 1988

INVENTOR(S) : Luigi Tozzi

It is certified that error appears in the above-identified patent and that said Letters Patent are hereby corrected as shown below:

In claim 5, line 3, please delete the word "extenal" and replace it with the word --external--.

Signed and Sealed this

Twenty-fourth Day of January, 1989

*Attest:*

DONALD J. QUIGG

*Attesting Officer*

*Commissioner of Patents and Trademarks*